United States Patent [19]

Malinowski

[11] 4,288,791

[45] Sep. 8, 1981

[54] SMOKE DETECTOR AND METHOD

[76] Inventor: William J. Malinowski, Johnson St., P.O. Box 274, Bryantville, Mass. 02327

[21] Appl. No.: 120,635

[22] Filed: Feb. 11, 1980

[51] Int. Cl.[3] ..... G08B 17/10

[52] U.S. Cl. ..... 340/630; 250/574; 356/439

[58] Field of Search ..... 340/628, 630; 250/573, 250/574, 575; 356/438, 439

[56] References Cited

U.S. PATENT DOCUMENTS

| | | | |
|---|---|---|---|
| 3,524,707 | 8/1970 | Hansen, Sr. et al. | 340/630 X |
| 3,599,195 | 8/1971 | Boyko | 340/561 |
| 4,186,390 | 1/1980 | Enemark | 340/630 |

*Primary Examiner*—John W. Caldwell, Sr.
*Assistant Examiner*—Daniel Myer
*Attorney, Agent, or Firm*—Morse, Altman, Oates & Dacey

[57] ABSTRACT

A smoke detector which responds to the presence of smoke or other aerosol particles within a smoke chamber. The detector includes a photocell and a pair of light sources, one light source aimed directly at the cell and the other light source shielded from direct illumination of the cell, but aimed at an inspection zone to which the cell is visible. The first light source shines in a generally steady state directly against the cell to bias the cell to a predetermined level. Cyclically, the first light source will be turned off and the second light source will be turned on to illuminate any smoke that may be present in the inspection zone. If smoke is present in excess of that which corresponds to the pre-bias of the cell, the output will rise due to reflection of light from the second light source against the smoke and onto the cell. The output will remain the same if the amount of smoke is equal to the pre-bias and the output will drop if the smoke is less than the pre-bias. Circuitry connected to the cell is adapted to respond to a change in the cell output and to actuate an alarm in the event that cell output is equal to or greater than a predetermined reference. A method for detecting the presence of smoke is also disclosed.

4 Claims, 5 Drawing Figures

SMOKE DETECTOR AND METHOD

BACKGROUND OF THE INVENTION

1. Field of the Invention

This invention relates generally to smoke detectors and the method of detecting smoke and more particularly is directed towards a new and improved smoke detector of simplified construction and operation and one that is thermally stable. This invention also relates to a novel method for detecting smoke by means of a cylindrical sequence of simplified steps.

2. Description of the Prior Art

Conventional optical smoke detectors operate on reflected light principles by which a light source is directed towards an examination zone through which smoke is adapted to pass. A photocell is also directed at the zone and is adapted to respond to light reflected from any smoke particles illuminated by the light source. In my copending applications Ser. No. 824 filed Jan. 4, 1979 and Ser. No. 023.033, filed Mar. 23, 1979, both entitled "Smoke Detection and Method", there is disclosed a smoke detector comprised of two light sources and one cell. One of the light sources is adapted to illuminate an inspection zone while the other light source is employed to pre bias the cell. If no smoke is present the output of the cell will decay at a rate faster than would be the case if smoke were present. Timing circuitry is provided to measure the decay time and to actuate an alarm if the time exceeds a predetermined amount. The detector involves the operation of a ramp circuit and the making of precise measurements with respect to the decay time of the cell output.

It is an object of the present invention to provide improvements in optical smoke detectors of the foregoing type. Another object of this invention is to provide an optical smoke detector of improved construction and operation and one which responds to a simple change in the output of the cell. Another object of this invention is to provide a thermally stable smoke detector. A further object of this invention is to provide a novel method for detecting smoke by means of an optical smoke detection system.

SUMMARY OF THE INVENTION

This invention features an optical smoke detector comprising a pair of light sources and a photocell disposed in operative relation to one another with respect to an inspection zone whereby one light source is directly visible to the cell while the other is visible only indirectly to the cell by reflection against smoke present in a detection zone. Control means are provided to illuminate the first light source on a substantially continuous basis in order to bias the cell to a predetermined output corresponding to the output of the cell if a certain percentage of smoke were present in the zone. Cyclically, the first light source will be turned off and the second light source will be turned on for a short period of time in order to illuminate the inspection zone and reflect light from any smoke present onto the cell. If the amount of smoke present in the zone is equal to that corresponding to the bias, the cell output will remain steady. The cell voltage will increase if the amount of smoke present exceeds that corresponding to the bias. The cell voltage will decrease if no smoke is present or if the amount of smoke present is less than that corresponding to the bias. Level detection circuitry is connected to the cell to sense any change in the cell output and to actuate an alarm if the cell output is equal to or greater than a certain predetermined reference level.

This invention also features a method of detecting smoke by electro-optical means, comprising the steps of first illuminating a photocell at a substantially steady state with a first light source, cyclically turning off the first light source and turning on a second light source for a short period of time to illuminate an inspection zone to which the cell is directly visible. The second light source is in directly visible to the cell whereby any smoke present in the zone will reflect from the second light source against the cell. An alarm is actuated in the event that the cell output exceeds a predetermined reference level.

BRIEF DESCRIPTION OF THE DRAWINGS

FIG. 5 is a circuit diagram of a voltage regulator made according to the invention.

DETAILED DESCRIPTION OF THE PREFERRED EMBODIMENTS

Figure 1:
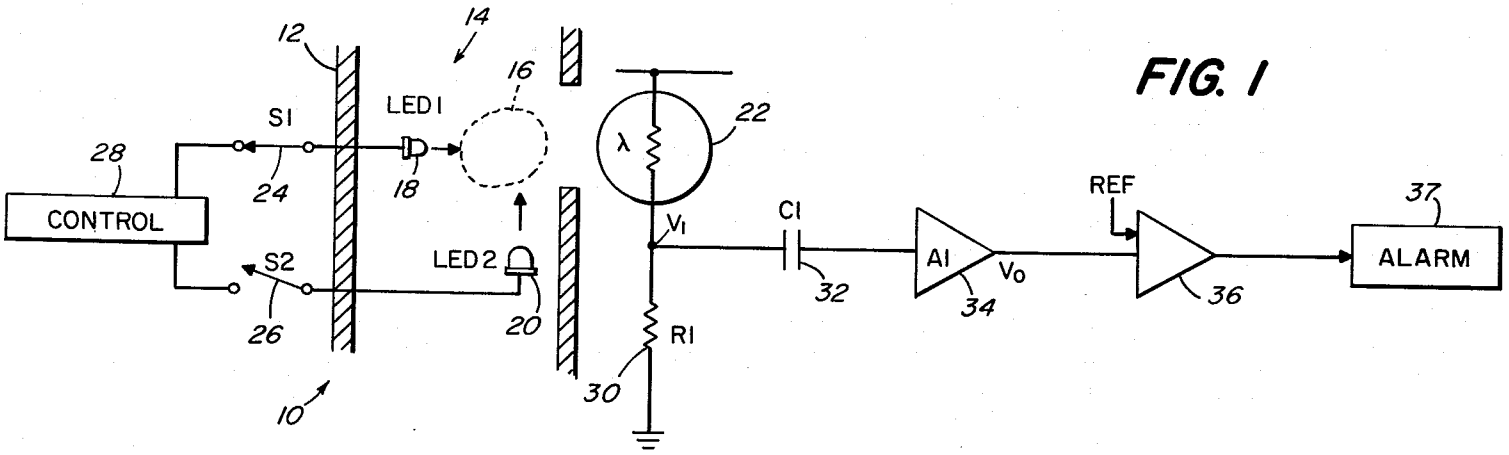
FIG. 1 is a schematic diagram of an analog type smoke detector made according to the invention.

Referring now to the drawings and to FIG. 1 in particular, the reference character 10 generally indicates a smoke detection system organized about a housing 12 defining a chamber 14 which is open to ambient atmosphere, but normally protected from a ambient light conditions by known means. The chamber 14 is designed to provide an examination zone in which aerosols such as smoke particles may pass for detection purposes. In FIG. 1 a cloud of smoke particles is indicated at 16 and a pair of light sources 18 and 20 are provided in association with the housing 12. In the preferred embodiment the light sources 18 and 20 are light emitting diodes. As illustrated, the light source 18 is aimed directly at the cell of a photo responsive device 22 which is visible to the interior of the chamber and adapted to respond to any light reflected from smoke particles illuminated by the light source 20. The light source 20 is so mounted to the housing that its light will not impinge directly on the cell 22 but will illuminate any smoke cloud 16 that may be present in the chamber and, by reflection against the smoke particles, indirectly illuminate the cell 22.

The light sources 18 and 20 are connected by switches 24 and 26, respectively, to a control unit 28 which opens and closes the switches in a predetermined timed sequence to be described more fully below. The cell 22 is connected by a resistance 30 to ground and also to a capacitor 32 in series with an amplifier 34. The output of the amplifier 34 is to a level detector 36 which, in turn, connects to an alarm unit 37.

The circuit operates in the following manner. During most of the cycle of operation of the circuit, the switch 24 is closed and the switch 26 is open so that the light source 18 is on and the light 20 is off. Under these conditions the light source 18 shines directly on the cell 22 at a continuous level, forcing the cell output to an equivalent 2% (for example) smoke level, producing a voltage output V1 from the cell 22. The capacitor 32 serves to isolate the amplifier 34 from the DC voltage V1. After a period of time the circuit will settle out and the amplifier output Vo assumes a substantially steady state value, which typically is one-half the power supply although this obviously may be varied. The switch S1 is then opened, turning off the light source 18 and, simultaneously, the switch 26 is closed to turn on the light source 20. The result of the switching operation is that the voltage output V1 (1) will drop if no smoke is present in the chamber or the amount of smoke is less than that corresponding to the pre-bias, or (2) will remain constant if there is a 2% smoke concentration present in the chamber, or (3) will increase if the smoke concentration is an excess of 2%. The resulting change or no change of the cell output is AC coupled into the amplifier 34 which amplifies the signal to a useful level and feeds it to the level detector 36 provided with a reference level input. Assuming a fixed on time for the switch 26, Vo can be sampled at the end of the on time and it can be determined if smoke equal to, in excess of 2%, at some point below 2% (or some other preselected value,) has been present in the chamber. This, of course, may then be used to operate the alarm 37 if the detected signal is equal to or exceeds the reference signal. Insofar as the light sources 18 and 20 are of the same material, the system is thermally stable in operation although V1 may change due to temperature and cell and LED thermal shifts, the change in V1 due to smoke or no smoke will be relatively unchanged.

Typically, the detector is driven by a power supply of 5 volts and, in practice, the amplifier, which preferably is a linear amplifier, is biased to produce one-half the power supply, or 2.5 volts, for example. The amplifier should have sufficient gain, as to provide a usable output. Detection is carried out at some preselected percentage of the power supply at Vo. In the preferred embodiment of the invention the AC amplifier 34 and the level detector 36 track one another. The circuit is designed to detect whether Vo is somewhere in the middle above ground. In practice, switch S1 is closed during most of the operation of the system with the light source 18 being on. Cyclically, for example every ten seconds, the switch S1 opens at time To to turn off the light 18 and switch 24 is closed for a brief period, typically 200–250 milliseconds to turn on the light source 20 until the time T1. If smoke is present in the chamber, the light source 20 will cause light to reflect from the smoke particles 16 onto the cell 22. The cell output will rise if the amount of smoke present exceeds the 2% bias on the cell from the light source 18. Typically, this will produce a Vo in excess of 2.5 volts. If the amount of smoke present is on the order of 2% then the cell output Vo remains the same and will be approximately 2.5 volts, for example. If no smoke is present or is less than 2%, Vo will drop. The detector can be set to actuate the alarm at any selected smoke level although, in practice, it is set to produce an alarm signal if the smoke present exceeds a density that is slightly below the 2% bias level of the cell. Other reference levels may also be utilized, if desired.

Figure 2:
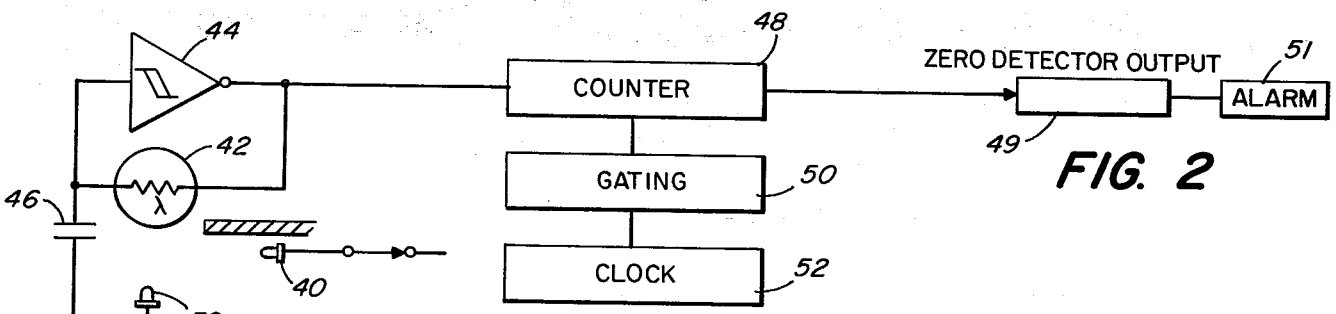
FIG. 2 is a schematic diagram showing a digital embodiment of the invention.
Figure 3:
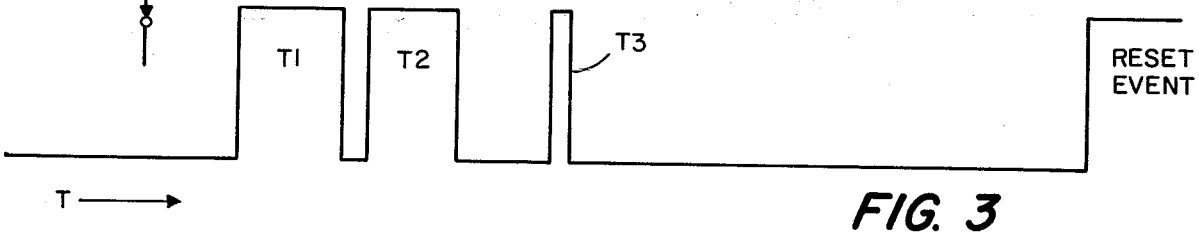
FIG. 3 is a timing diagram.

Referring now to FIG. 2 of the drawings there is illustrated a modification of the invention and, in this embodiment a smoke detector similar to that of FIG. 1 embodiment is provided in a digital circuit arrangement. In the FIG. 2 embodiment a pair of light sources, preferably in the form of light emitting diodes 38 and 40, are operatively associated with a smoke chamber in the same fashion as in the principal embodiment with the LED 38 aimed directly against a cell 42 while the LED 40 is aimed at a inspection zone visible to the cell 42 so that the cell 42 can be illuminated by the LED 40 only by reflection. The photocell 42 is connected across a hysteresis amplifier 44 with both connected to ground through a capacitor 46. The output of the amplifier 44 is to a counter 48 which is also connected to gating circuits 50 and a clock 52.

The circuit operates in the following manner. First, the counter 48 counts up during time T1, while the LED 38 is illuminated to pre bias the photocell 42. Next, the counter 48 counts down during the time T2 during which time the LED 38 is turned off and the LED 40 is turned on. If no smoke is present during time T2, the counter does not reach zero. On the other hand if smoke is present, the counter 48 goes to zero and below. A zero detector output 49 connected to the counter will, in such event, be actuated to operate an alarm 51. Next, the counter is reset for the next cycle of operation.

Figure 4:
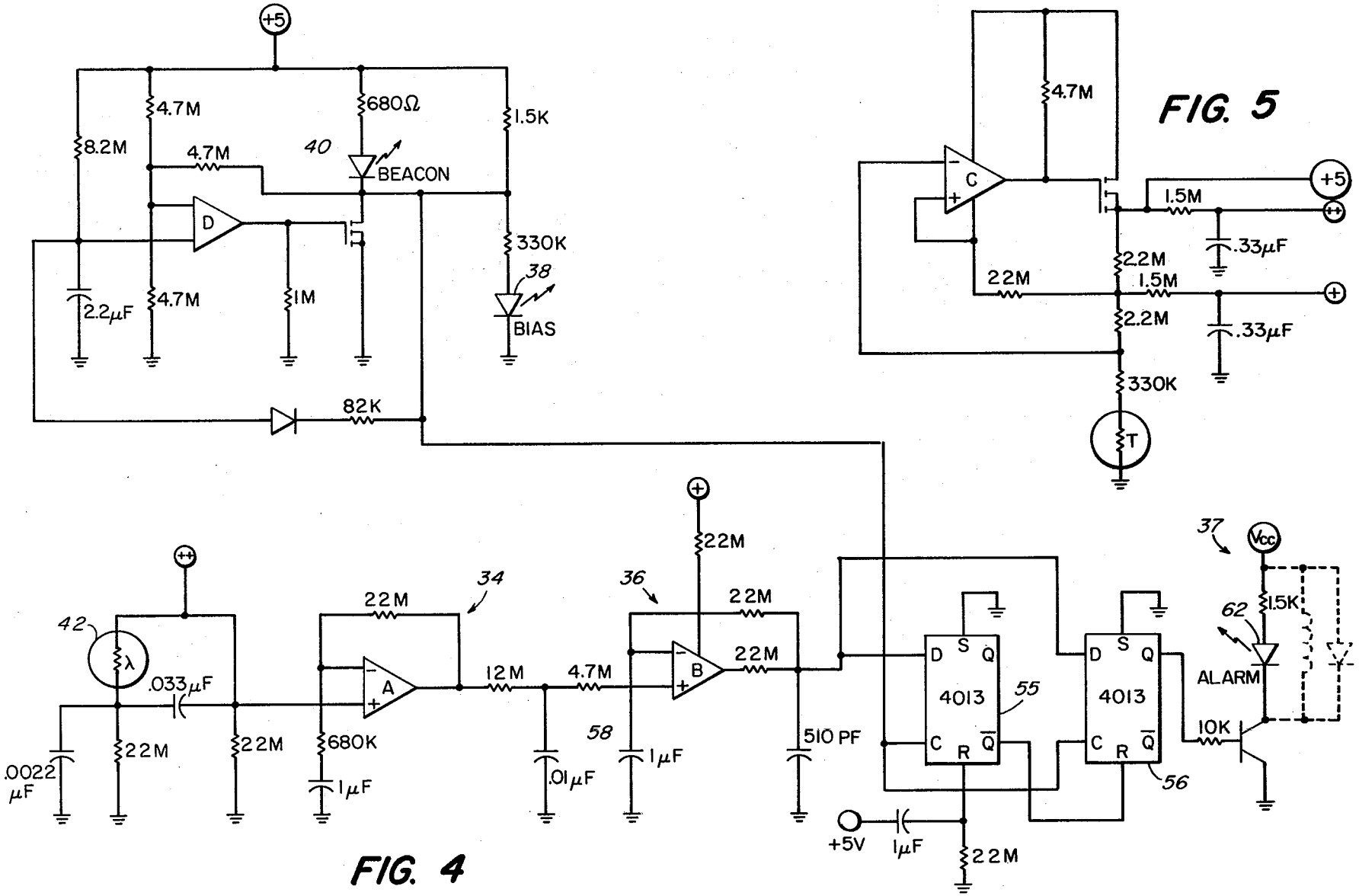
FIG. 4 is a circuit diagram illustrating details of the analog embodiment of the invention.

As shown in FIG. 4, the circuitry for the analog embodiment of the invention includes a square wave generator 54 which serves as a clock in generating timing pulses for the circuit. In the preferred embodiment the square wave generator produces a pulse window of 200–250 milliseconds. Data is clocked to flip-flops 55 and 56 at the end of that 200 MS period. At the end of a bias (typically 10 seconds) pulse the switch to the bias LED 38 is opened while the switch to the beacon LED 40 is closed with clock signals going to the flip-flops 55 and 56. The photodetector 42 provides an output through the amplifier 34 having a biasing network and providing the necessary gain and filtering of the input signal. The amplified signal is then fed to the level detector 36 provided with a reference input from a reference capacitor 58 which accumulates a charge for comparison with the amplified signal from the cell. If no smoke is present or if the amount of smoke produces a signal that is less than the reference signal, the flip-flops are reset, whereas if two successive pulses exceed the level set on the level detector, an alarm signal is generated causing an indicator light 62 in the alarm 37 to be actuated. If there is no output from the level detector, the flip-flops are automatically reset. The reset circuit holds the circuit in a reset mode as start up or if the power supply is interrupted.

In FIG. 5 there is illustrated a circuit diagram of a voltage regulator which may be used to supply a stable voltage for the circuit.

Both digital and analog circuits operate on the basis of determining whether or not the output of the cell during its sampling period exceeds a predetermined level and to generate an alarm if that level is exceeded by the cell output.

The detector is very stable in operation over a wide temperature range. The circuit components are relatively simple so that a low cost smoke detector is provided and current requirments for the circuit are constant. The detector is idealy suited for battery operation.

While the invention has been described with particular reference to the illustrated embodiments, numerous modifications thereto will appear to those skilled in the art.

For example, in the digital version of the invention an A/D converter may be used to measure voltages at time To and T1. At time To the output of the A/D converter would be placed in memory and then compared with the output of the converter at time T1. An alarm would be actuated in the event that the count is equal to or greater than a predetermined amount.

Having thus described the invention, what I claim and desire to obtain by Letters Patent of the United States is:

1. The method of detecting the presence of an aerosol within a volume above a predetermined concentration thereof, comprising the steps of (a) first, illuminating a photo-responsive device exposed to said volume for a relatively long period of time and at a relatively low power level to pre-bias said device and generate a first electrical output therefrom corresponding to said predetermined concentration of said aerosol, (b) secondly, periodically terminating the first step and illuminating said volume for a relatively short period of time and at a relatively high power level whereby any aerosol present in said volume will reflect light onto said device to produce a second electrical output therefrom, (c) thirdly, comparing said second electrical output with said first electrical output, and, (d) generating an alarm in the event that said second electrical output is at least equal to said first electrical output.

2. A system for detecting an aerosol such as smoke or the like, comprising (a) means defining an examination zone in which smoke and the like is adapted to pass, (b) a photo responsive device mounted in position to monitor the zone, (c) a first light source of relatively low intensity mounted in position to illuminate said photo responsive device and pre-bias said device by an amount corresponding to a predetermined concentration of aerosol in said zone, (d) a second light source of relatively high intensity mounted in position to illuminate only said zone and any aerosol therein, (e) power means for energizing said system, (f) control means operatively connected to said power means, said light sources and said photo responsive device for cyclically operating said light sources in timed sequence of relatively long pulses of light from said first source and relatively short pulses from said second source whereby a relatively long pulse of light from said first source will illuminate said photo responsive device to pre-bias said device and generate a first output therefrom and a relatively short pulse of light from said second source after said long pulse will illuminate said zone and reflect against any aerosol present therein and onto said photo responsive device to generate a second output therefrom, (g) detecting means for comparing said first and second electrical outputs, and, (h) alarm means operatively connected to said detecting means and adapted to be actuated by said detecting means in the event that said second electrical output from said device produced by said short pulse of light is at least equal to said first electrical output.

3. A system according to claim 2 wherein said detecting means includes a capacitor connected to said device and adapted to be charged by the output of said device and an amplifier connected to said capacitor for amplifying the output of said capacitor.

4. A system according to claim 2 wherein said detecting means includes pulse generating means selectively responsive to said first and second light sources, counting means connected to said generating means for separately counting the pulses therefrom while said light sources are separately energized, level sensing means connected to said photo responsive device and adapted to generate an excess level signal when the output of said photo responsive device exceeds a predetermined level, said counting means being connected to said level sensing means and adapted to produce an alarm signal in the event of an excess level signal occuring after a predetermined number of pulses from said pulse generating means.

* * * * *